United States Patent [19]

Henning et al.

[11] Patent Number: 5,058,608

[45] Date of Patent: Oct. 22, 1991

[54] FILTER CIGARETTE

[75] Inventors: Paul-Georg Henning; Werner Schneider, both of Quickborn, Fed. Rep. of Germany

[73] Assignee: B.A.T. Cigarettenfabriken GmbH, Hamburg, Fed. Rep. of Germany

[21] Appl. No.: 463,059

[22] Filed: Jan. 10, 1990

[30] Foreign Application Priority Data

Jul. 21, 1989 [GR] Greece ..... 89.0100471

[51] Int. Cl.[5] ..... A24D 3/04; A24D 3/18

[52] U.S. Cl. ..... 131/336; 131/340; 131/344

[58] Field of Search ..... 131/336, 344, 340

[56] References Cited

U.S. PATENT DOCUMENTS

| | | |
|---|---|---|
| 2,819,720 | 1/1958 | Burbig . |
| 3,396,733 | 8/1968 | Allseits . |
| 3,847,161 | 11/1974 | Morgenstern . |
| 4,273,141 | 6/1981 | Van Tilburg . |

FOREIGN PATENT DOCUMENTS

| | | |
|---|---|---|
| 801728 | 10/1973 | Belgium . |
| 0101173 | 2/1984 | European Pat. Off. . |
| 3625593 | 5/1989 | Fed. Rep. of Germany . |

OTHER PUBLICATIONS

Prospects of Filtrona.

"Beiträge zur Tabakforschung International", vol. 12, No. 4, 178, 179 1984.

German Utility Model No. 1 794 665.

Die Tabakzeitung, 28 Aug. 1984.

Norman, V., "The Effect of Perforated Tipping Paper on the Yield of Various Smoke Components", Beitrage zur Tabakforschung, Band 7, Helf 5, Sep. 1974, pp. 282–287.

Copy of Affidavit of Albert B. Hudson to DE 36 25 593.

*Primary Examiner*—V. Millin

*Attorney, Agent, or Firm*—Armstrong, Nikaido, Marmelstein, Kubovcik & Murray

[57] ABSTRACT

A filter cigatette comprises a tobacco rod having a tobacco mixture with a low packing or filling density, a first filter element racing the tobacco rod, having a retention capacity of 40 to 80% and consisting of a fibrous material having a low single denier and a high total denier, a second filter element facing the mouth of the smoker and having a retention capacity of 15% at the maximum, and a hollow chamber formed between the two filter elements and having a length of 3 to 7 mm at an overall length of the filter between 18 and 30 mm. The two filter elements and the hollow chamber are surrounded by a paper wrapper and an air-permeable tipping paper with a ventilation zone in the region of the hollow chamber; said ventilation zone ensures a ventilation degree of 50 to 85% and is created on the finished cigarette by laser beams or by mechanically produced perforations through both papers.

In this way a more intensive taste sensation can be achieved together with a low nicotine to condensate ratio.

6 Claims, 1 Drawing Sheet

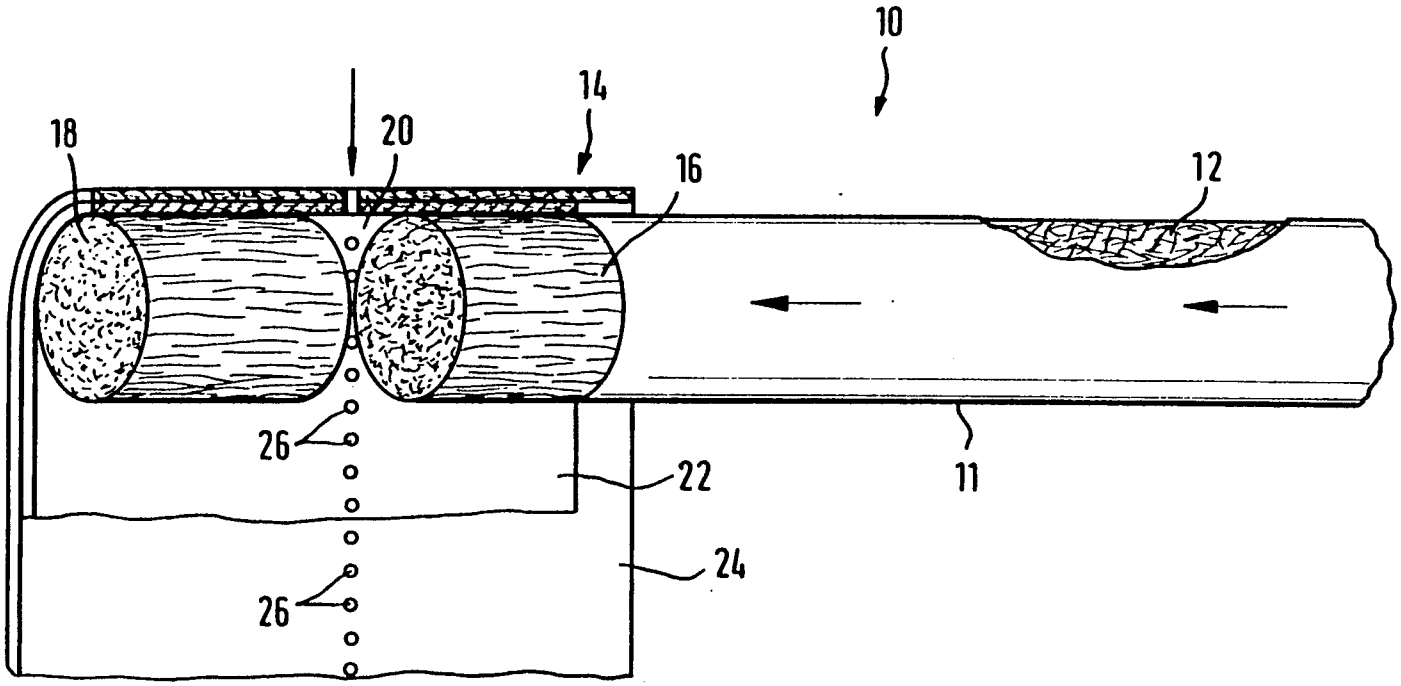
10
12
11
14
16
18
20
22
24
26
26

FILTER CIGARETTE

BACKGROUND OF THE INVENTION

1. Field of the Invention

The invention relates to a filter cigarette with a nicotine-to-condensate-ratio of 1.3 at the maximum comprising a tobacco rod surrounded by a cigarette paper, a first filter element facing the tobacco rod and consisting of a fibrous material having a low single denier, a high total denier and an appropriately high retention capacity, a second filter element facing the mouth of the smoker and having a low retention capacity, a hollow chamber disposed between the two filter elements and having a length of 3 to 7 mm at an overall length of the filter between 18 and 30 mm, an air-impermeable tipping paper for attaching the two filter elements to the tobacco rod and a filter ventilation zone in the tipping paper in the region of the hollow chamber, said filter ventilation zone extending in the circumferential direction and being produced on the finished filter cigarette by mechanical means or by laser irradiation.

2. Description of the Prior Art

Such a filter cigarette is known from the embodiment shown in FIG. 3 of published European patent application No. 101,173, and comprises a tobacco rod surrounded by a cigarette paper, a first filter element facing the tobacco rod made of a fibrous material with a low single denier and a high total denier and having an appropriately high retention capacity, a second filter element facing the mouth of the smoker and having a low retention capacity, a hollow chamber disposed between the two filter elements and having a length of 3 to 7 mm at an overall filter length between 18 mm and 30 mm, a wrapper surrounding the two filter elements and the hollow chamber, an air-impermeable tipping paper for attaching the two filter elements to the tobacco rod, and a filter ventilation zone (in the tipping paper and the wrapper) extending in circumferential direction located in the region of the hollow chamber and made on the finished filter cigarette mechanically or by laser beams.

No detailed information is given regarding the dimensions and/or properties of the various elements of this filter and of the tobacco rod other than pointing out that the filter element facing the tobacco rod effects the predominant portion of the filter efficiency, namely in the range of 80 to 90% or more, and therefore consists of a Tow Material with a small single denier and large total denier, while the filter efficiency of the filter element facing the mouth of the smoker is relatively small.

Here, the ventilation air passes through the ventilation zone into the hollow chamber and is mixed thereat with the smoke stream which has already been strongly filtered through the filter element facing the tobacco rod. This mixture then flows through the second filter element facing the mouth of the smoker and having only a relatively low filter efficiency, and reaches the mouth of the smoker from there.

This structure is supposed to provide improved taste due to the fact that the major portion of the components of the smoke affecting the taste reaches the mouth of the smoker, while the nicotine-to-condensate-ratio is relatively high.

Such a filter cigarette provides a significantly more intense taste sensation than filter cigarettes which are equal in accordance with DIN standards, i.e. with respect to condensate and nicotine, and have a ventilated cellulose acetate single filter or ventilated double filters without a mixing chamber. Furthermore due to the blending and/or thorough mixing of smoke and ventilation air in the hollow or mixing chamber, no typical smoke pattern arises at the mouth side of the second filter element. Smoker tests have shown that such patterns are undesirable; with conventionally ventilated filters, "white ring" is formed by the ventilation air enveloping the smoke; other patterns can be formed if air and smoke are conducted separately to the exit end of the filter facing the mouth of the smoker, as well as "star-shaped" patterns for ventilation through few but very large perforation holes. Other smoke patterns have also been observed and objected to.

A nicotine-to-condensate-ratio of 1.5 can be obtained with these filter cigarettes of known construction, this ratio being computed from the formula:

$$\text{nicotine content/condensate} \times 10.$$

For many applications, however, an attempt is made to obtain smaller nicotine-to-condensate-ratios of 1.3 at the maximum. Furthermore, smoker tests have shown that for many variants of such a filter consisting of three filter elements, the taste sensation still leaves something to be desired.

SUMMARY OF THE INVENTION

Accordingly, the invention has as its object the provision of a filter cigarette of the indicated kind, which preserves the advantages of the known filter cigarette and ensures a better taste sensation without increasing the nicotine-to-condensate-ratio above 1.3.

In a filter cigarette with a nicotine-to-condensate-ratio of 1.3 at the maximum comprising a tobacco rod surrounded by a cigarette paper, a first filter element facing the tobacco rod and consisting of a fibrous material having a low single denier, a high total denier and an appropriately high retention capacity, a second filter element facing the mouth of the smoker and having a low retention capacity, a hollow chamber disposed between the two filter elements and having a length of 3 to 7 mm at an overall length of the filter between 18 and 30 mm, an air-impermeable tipping paper for attaching the two filter elements to the tobacco rod and a filter ventilation zone in the tipping paper in the region of the hollow chamber, said filter ventilation zone extending in the circumferential direction and being produced on the finished filter cigarette by mechanical means or by laser irradiation. This object is achived in accordance with the invention by the following features:

The first filter element facing the tobacco rod has a retention capacity of 40 to 80%, the second filter element facing the mouth of the smoker has a retention capacity of 15% at the maximum, the nicotine-to-condensate-yield ratio of the tobacco rod is between 0.5 and 1.2, the packing density of the tobacco mixture of the rod is between 190 and 230 mg/ml, the draw resistance of the tobacco rod is between 40 and 65 mm water column measured under closed conditions, the air permeability of the cigarette paper is 15 to 40 Coresta units, and the filter ventilation degree is 50 to 85%.

Advantageous embodiments are defined by the features of the subclaims.

The advantages achieved by the invention are based on the design of a special filter cigarette structure with specifically adapted parameters, namely the retention capacity of the two filter elements, the rod yield ratio nicotine-to-condensate of the tobacco rod, the packing density of the tobacco mixture in the tobacco rod, the resistance to draw of the tobacco rod, the air permeability of the cigarette paper, and finally the ventilation degree of the filter towards the aim of an overall design which optimizes, on the one hand, the taste sensation, and, on the other hand, the condensate yield. Here, the nicotine yield of the filter cigarette is 1.0 mg at the maximum, and the condensate yield is from 1 mg to 8 mg, while simultaneously maintaining the desired nicotine-to-condensate-ratio at 1.3 at the maximum.

As smoker tests have shown, such a filter in combination with the tobacco rod provides a substantially more intense taste sensation than the filter in accordance with published European Patent Application No. 101,173 and additionally provided the advantages of the known three-part construction, especially the avoidance of the smoke patterns mentioned above.

The desired air permeability of the cigarette paper in the range of 15 to 40 Coresta units (CU=Coresta Unit=$cm^3$/min $cm^2$100 mm water column) involves low to medium values which can readily be achieved by commercially available cigarette papers.

Although the desired effect can already be obtained if the overall length of the filter is between 18 and 30 mm, for reasons of simplifying the manufacture it is preferred, as with customary filters, that the overall length of the filter be 21 mm with a diameter of 7.95 mm. In this case existing machines can be used.

The desired ventilation degree of 50 to 85% can be achieved by the appropriate construction of the ventilation zone in the tipping paper and the wrapping paper disposed over the hollow chamber. According to a preferred embodiment, the ventilation zone is formed by a row of holes spaced at least 10 mm from the mouth-facing end of the filter; the holes are produced on the finished cigarette either by laser irradiation or by mechanical means, and should be as large as possible. From 5 to 30 holes can be used; good results are achieved with 10 to 20 holes in the ventilation row.

Surprisingly, a more intense taste sensation can be perceived only if both of the superimposed filter papers, i.e. the air-permeable or air-impermeable wrapping paper and the air-impermeable tipping paper are perforated jointly on the finished cigarette by mechanical means or by laser irradiation, laser perforation being preferred.

The first filter element facing the tobacco rod should consist of a cellulose acetate filter material having a Y-crossection and a single denier as low as possible, i.e. in the range of 1.5 to 2.5 dpf (denier per filament) in order to obtain the desired high retention. The total denier of this first filter element should be high, namely greater than 50,000.

In practice, the desired, extremely high retention capacity can be achieved, for example, by using two tows having respectively a Y-crossection, a single denier of 2.1 dpf and a total denier of 36,000, so that an effective total denier of 72,000 results.

The second filter element facing the mouth of the smoker also contains cellulose acetate filter material, but is made of the coarsest fibers possible, i.e. with a relatively high single denier in the order of 8 to 12 dpf. The shape of the crossection plays only a minor role, i.e. fibers with a round or with a Y-crossection can be used. A relatively low total denier of 20,000 to 35,000 is preferred.

In this way, the second filter element attains a retention capacity between 0 and 15%, the lower limiting value of "zero" being expressly excluded, i.e. the second filter element must in any case have an albeit small filtering effect.

BRIEF DESCRIPTION OF THE DRAWINGS

The invention will now be more fully explained hereinafter by reference to embodiments given hereinbelow in conjunction with the single-figure drawing, which is a prespective view of a filter cigarette according to the invention with its wrapper partly lifted off.

DESCRIPTION OF THE PREFERRED EMBODIMENTS

The filter cigarette generally denoted by reference numeral 10 comprises a tobacco rod 12 surrounded by a cigarette paper 11 and a filter 14 connected with said tobacco rod 12.

The packing density of the tobacco mixture of the tobacco rod 12 is low and lies between 190 and 230 mg/ml. The resistance to draw of the rod is likewise as low as possible and lies between 40 and 65 mm water column when measured with the ventilation openings closed.

The cigarette paper 11 has a low to medium air permeability in the range of 15 to 40 Coresta units with $$CU = \text{Coresta Unit} = \frac{cm^3}{\text{min } cm^2 \text{ 100 mm water column}}$$

The nicotine-to-condensate yield ratio of the tobacco rod mixture should be between 0.5 and 1.2.

The filter 14 consists of three separate parts, namely a first filter element 16 facing the tobacco rod, a second filter element 18 facing the mouth of the smoker, and a hollow chamber 20 formed between the two other filter elements 16 and 18. The two filter elements 16 and 18 and the hollow chamber 20 are preferably surrounded by a wrapping paper 22 which is air-impermeable in the embodiment shown. For the effect of the filter the wrapping paper is not absolutely necessary in terms of function, but is used only during the overall manufacture of the filter for "holding together" the individual parts (elements).

The length of the wrapping paper 22 corresponds to the overall length of the filter, i.e. to the longitudinal dimensions of the two filter elements 16 and 18 and of the hollow chamber 20.

An air-impermeable tipping paper 24 surrounds the wrapping paper 22 and serves to attach the actual "filter tip", made up of the two filter elements 16 and 18, the hollow chamber 20 and the wrapping paper 22, to the tobacco rod 12. That is to say, the tipping paper 24 extends somewhat beyond the tobacco rod 12, as can be seen in the Figure.

Preferably in the middle of hollow chamber 20, seen in the longitudinal direction of the filter 14, ventilation openings 26 are formed in both the wrapping paper 22 and the tipping paper 24 and are denoted by points in the Figure.

These ventilation openings or holes can be made by mechanical means or by laser irradiation.

As an alternative to the embodiment shown, tipping paper 22 may also be air-permeable, but in any case it is necessary that the ventilation perforations made on the finished cigarette pass through both papers.

The ventilation openings 26 are arranged in a cross-sectional plane of the hollow chamber 20, i.e. they lie on one line if the two papers 22 and 24 are unrolled.

During the smoking of the cigarette 12 the stream of smoke from the tobacco rod 12, indicated by the arrow, flows into the first filter element 16, which has a very high retention capacity of 40 to 80% and a length of at least 5 mm.

This high retention capacity can be achieved by using a cellulose acetate filter material having the lowest possible single denier in the range of 1.5 to 2.5 dpf (denier per filament) and a Y-crossection. The total denier of the first filter element 16 is high and in any case greater than 50,000.

The unretained portion of the smoke stream flows from the first filter element 16 into the hollow chamber 20, into which ventilation air is drawn through the ventilation openings 26 and is mixed thereat with the smoke stream. The hollow chamber 20 should have a length of 3 to 7 mm and ensure a 50 to 85% ventilation degree, which is achieved with five to thirty holes, especially 10 to 20 holes 26; the individual holes 26 should be as large as possible.

The mixture of smoke stream ventilation air flows from the hollow chamber 20 into the second filter element 18, which likewise contains cellulose acetate filter material but with the coarsest possible fibers, namely a high single denier in the order of 8 to 12 dpf. The total denier of the second filter element 18 is relatively low and in the range of 20,000 to 35,000. In this way, a retention capacity of 0 to 15% can be adjusted.

The second filter element 18 should be at least 7 mm long, with the distribution of the various partial lengths of the first filter element 16, the hollow chamber 20, and the second filter element 18, resulting into an overall length of the filter 14 of 18 to 30 mm.

Tests with such a filter 14 with the indicated dimensions and properties in combination with the specified tobacco rod have led to a condensate yield of 1 to 8 mg and a nicotine yield of 1.0 mg at the maximum, the nicotine-to-condensate ratio being 1.25 at the maximum.

Compared with the filter in accordance with published European patent application No. 101,173, a substantially more intense taste sensation was produced, as proven by smoker tests.

Two practical embodiments of the filter cigarette 10 are described below with the following, joint specifications and the associated standard smoking values according to DIN (Deutsche Industrie Norm=German Industrial Standard):

The packing density of the tobacco mixture of the tobacco rod was 225 mg/ml, the draw resistance of the rod was 55 mm water column, and the rod's nicotine-to-condensate yield ratio was 0.95. The air permeability of the cigarette paper 11 was 25 Coresta units.

The overall length of the filter 14 was 21 mm and its diameter was 7.95 mm, so that this filter 14 could be processed on conventional filter making machines and filter assemblers.

The first filter element 16 facing the tobacco rod had a length of 7 mm and consisted of cellulose acetate made from two filter tows with a Y-crossection and a single denier of 2.1 dpf; each tow had an overall denier of 36,000, so that the effective total denier of the filter element 16 could be assumed to be 72,000.

The draw resistance of the filter element 16 was 115 mm water column, measured under closed conditions; the effective retention degree for the condensate, including water, was 60%.

The hollow chamber 20 had a length of 5 mm.

The second filter element 18 had a length of 9 mm and consisted likewise of cellulose acetate with a single denier of 8 dpf and a total denier of 28,000. Here too fibers with a Y-crossection were used.

The effective retention degree of the second filter element 18 was 10%, and its draw resistance was 9 mm water column, measured under closed conditions.

The wrapping paper 22 had a length of 21 mm, and thus extended over the entire length of the filter 14. It consisted of an air-impermeable and smoke-impermeable material, namely a coated paper or a plastic film.

Tipping paper 24 had a width of 29 mm, measured from the mouth end of the filter 14 to the boundary line of the tipping paper 24 on the tobacco rod 12. It also consisted of an air-impermeable and smoke-impermeable material.

Both papers 22 and 24 were provided by on-line laser perforation on the finished cigarette during cigarette making, with a row of ventilation openings 26, which extend in the circumferential direction of the filter element 14 and are located in the middle of the hollow chamber 20.

In a first version of such a filter 14, a ventilation degree of 64% was adjusted by appropriate design of the number and the size of the ventilation openings 26 in the tipping paper 24 and the wrapping paper 22. The following standard smoking values according to DIN were measured for the filter cigarette 10:

Condensate: 5 mg
Nicotine: 0.6 mg

This means that the nicotine-to-condensate-ratio was 1.2.

In a second version, a ventilation degree of 80% was set by appropriate design of the number and size of the ventilation openings 26 in wrapping paper 22 and tipping paper 24. Now the standard smoking values according to DIN of the filter cigarette 10 were:

Condensate: 2 mg
Nicotine: 0.25 mg i.e. the nicotine-to-condensate-ratio was 1.25.

In taste tests, these filter cigarettes were judged positively. The above-described smoke patterns did not appear.

We claim:

1. A filter cigarette having a maximum nicotine-to-condensate-ratio of 1.3, comprising:

a tobacco rod having a nicotine-to-condensate-yield ratio of between 0.5 and 1.2 and a packing density, of the tobacco mixture composing the tobacco rod, of between 190 and 230 mg/ml, the draw resistance of the tobacco rod is between 40 and 65 mm water column, measured under closed conditions;

a cigarette paper surrounding the tobacco rod, said paper having a an air permeability in the range of 15 to 40 Coresta units;

a first filter element facing the tobacco rod consisting of a cellulose acetate fibrous tow having a Y-cross section and a low single denier of 1.5 to 2.5 dpf and a total denier greater than 50,000, said first filter element having a retention capacity of 40 to 80%;

a second filter element facing the mouth of the smoker having maximum retention capacity of 15%; and a filter comprising the first and second filter elements and a hollow chamber having a length of 3 to 7 mm disposed between the two filter elements, an air-impermeable tipping paper attaching the two filter elements to the tobacco rod, a filter ventilation zone in the tipping paper in the region of the hollow chamber circumferentially positioned on the tipping paper, and said filter has an overall length of between 18 and 30 mm, and a filter ventilation degree of 50 to 85%.

2. The filter cigarette as set forth in claim 1, wherein the ventilation zone is formed by a row of ventilation openings spaced at least 10 mm from the filter end facing the mouth of the smoker and situated in the middle of the hollow chamber.

3. The filter cigarette as set forth in claim 2, wherein the row has five to thirty ventilation openings, particularly ten to thirty ventilation openings.

4. The filter cigarette as set forth in claim 1, wherein the first filter element consists of two tows with 1.5 to 2.5 dpf.

5. The filter cigarette as set forth in claim 1, wherein the second filter element consists of cellulose acetate filter material with a single denier of 8 to 12 dpf and a total denier of 20,000 to 35,000.

6. The filter cigarette as set forth in claim 1, wherein the two filter elements and the hollow chamber are surrounded by a wrapper.

* * * * *